United States Patent [19]

Wright

[11] Patent Number: 5,076,553

[45] Date of Patent: Dec. 31, 1991

[54] FIXTURE FOR HOLDING THREADED WORKPIECES

[76] Inventor: Ronald L. Wright, 2240 First St., Simi Valley, Calif. 93065

[21] Appl. No.: 583,133

[22] Filed: Sep. 17, 1990

[51] Int. Cl.[5] ..... B25B 1/00

[52] U.S. Cl. ..... 269/9; 269/287; 269/101

[58] Field of Search ..... 33/199 R, 573, 481; 269/9, 900, 88, 287, 270, 277; 10/107 R; 279/7

[56] References Cited

U.S. PATENT DOCUMENTS

| | | | |
|---|---|---|---|
| 2,827,813 | 3/1958 | Totten | 33/199 A |
| 3,218,724 | 11/1965 | Schaumberger | 33/199 R |
| 3,406,461 | 10/1968 | Gunderson | 33/199 R |
| 4,540,164 | 9/1985 | Shade | 269/900 |
| 4,669,227 | 6/1987 | Treppner | 269/900 |
| 4,852,866 | 8/1989 | Kristoff | 269/277 |

FOREIGN PATENT DOCUMENTS

| | | | |
|---|---|---|---|
| 204300 | 7/1954 | Australia | 33/481 |

*Primary Examiner*—Robert C. Watson
*Attorney, Agent, or Firm*—Allan M. Shapiro

[57] ABSTRACT

The fixture for holding threaded workpieces is a right angle fixture. It has two integrally formed webs which have exterior planar surfaces at a right angle with respect to each other. There are holes through each of the webs. The holes are of selected diameters and each has therein threads of selected pitch. Securing of the fixture and placing a threaded fastener through its corresponding hole permits operations to be accomplished on the fastener.

7 Claims, 2 Drawing Sheets

FIG. 2
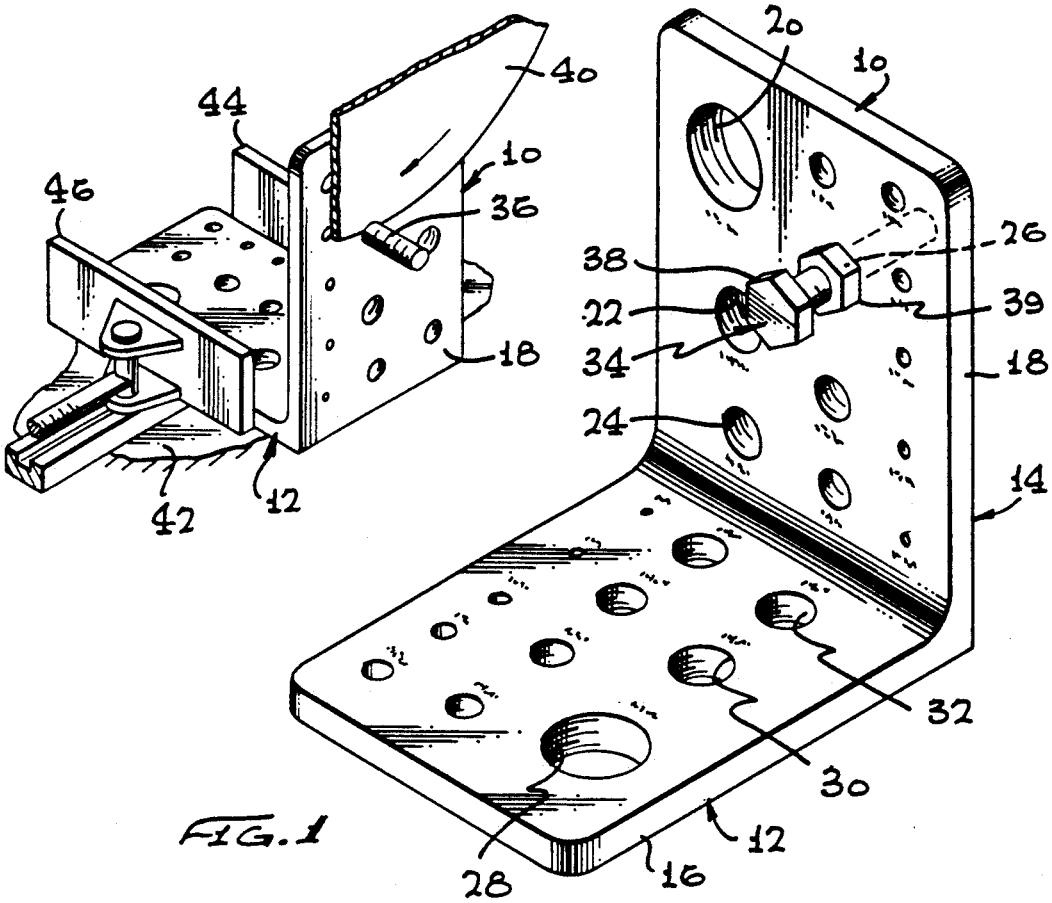
FIG. 1
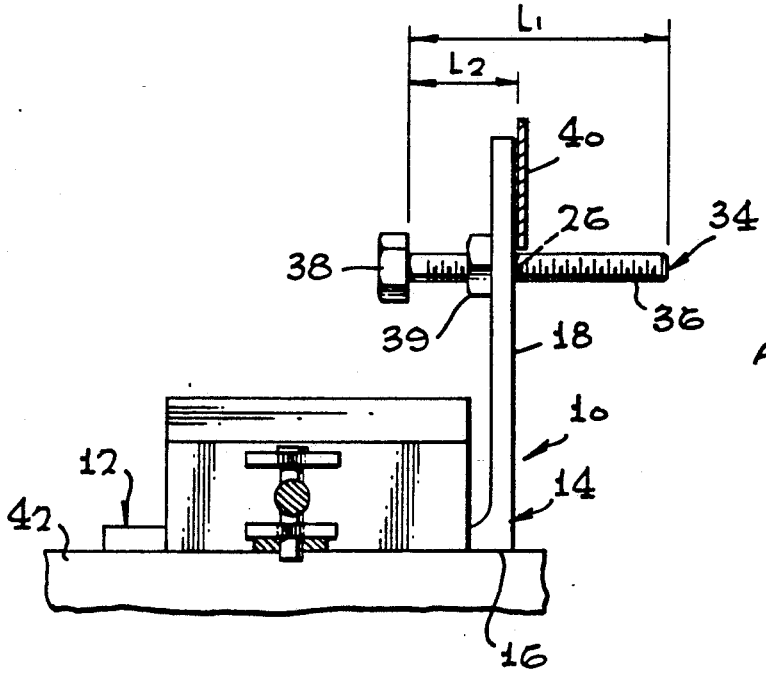
FIG. 3

FIG. 4
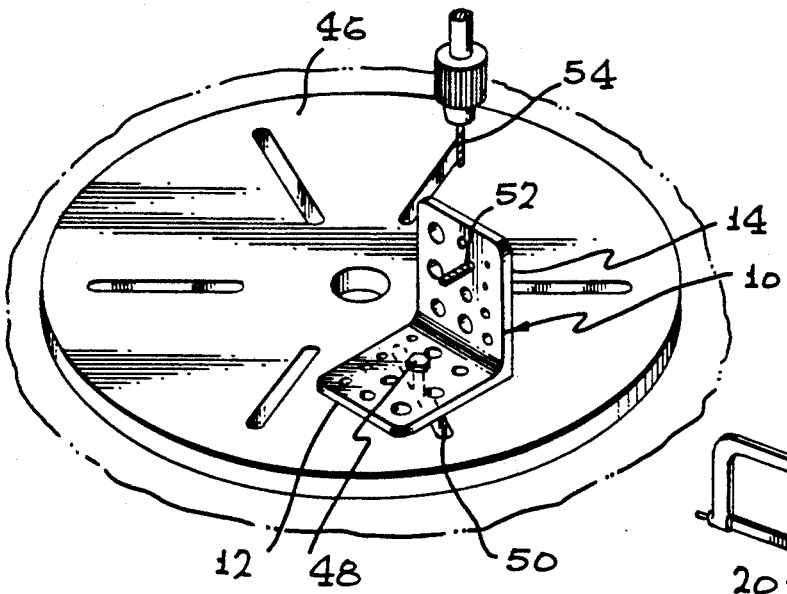
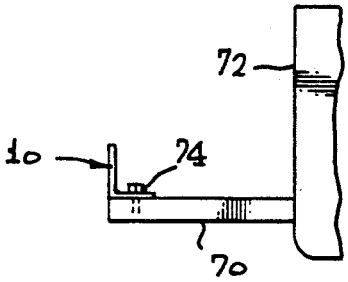
FIG. 7
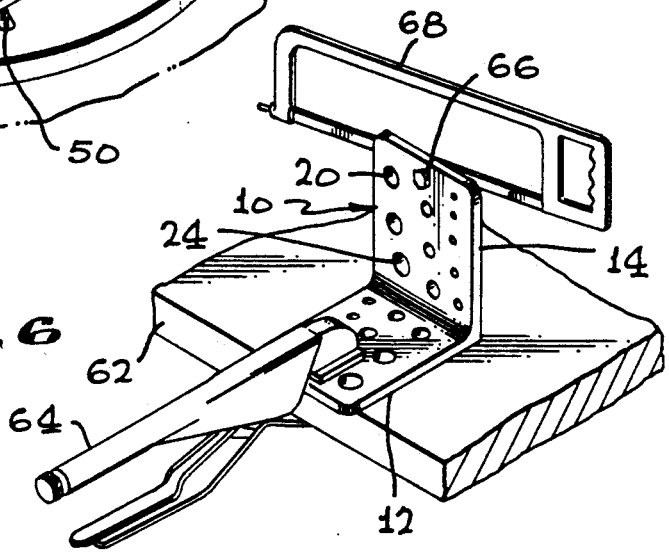
FIG. 6
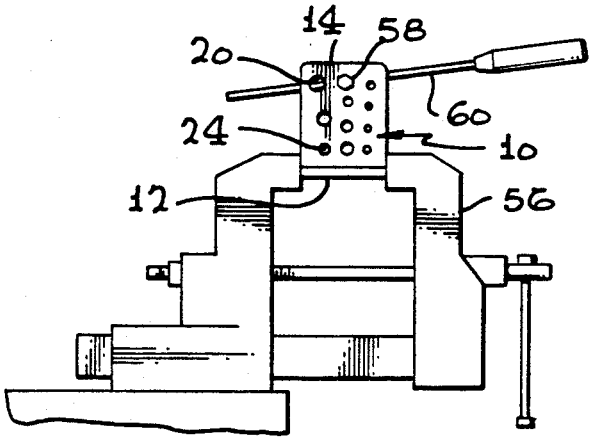
FIG. 5

FIXTURE FOR HOLDING THREADED WORKPIECES

FIELD OF THE INVENTION

This invention is directed to a fixture for holding threaded workpieces, and particularly an angle fixture which permits ready clamping of the fixture and appropriate positioning of a threaded workpiece for work thereon.

BACKGROUND OF THE INVENTION

It is often necessary to hold a threaded workpiece so that work may be done thereon. The threaded workpiece may be cut off by a power or hand saw. The threaded workpiece may be filed or ground to shape for a particular purpose. The threaded workpiece may be slotted at its free end or have a hole drilled therethrough adjacent its free end for fastening of the threaded workpiece. When such a threaded workpiece is simply clamped in a vice or other similar fixture, the threads thereon may be damaged. Furthermore, since the contact area is very small, it is difficult to hold such a threaded workpiece without slipping. In Duncan U.S. Pat. No. 1,208,552 and Peters U.S. Pat. No. 1,315,238, the attempt was to hold a machine screw or bolt by the clamping of its head. In Billman U.S. Pat. No. 2,438,989 and Totten U.S. Pat. No. 2,827,813, the threaded workpiece is clamped on its threads. In Billman, the clamping holder is divided on a plane passing axially through the threaded openings, and clamping is sideways, at a right angle with respect to that plane. The structure is linear in the sense that all openings have parallel axes. In Totten, clamping is by employment of two threaded plates in line with each other. When the workpiece is threaded into the holes in the two plates, they are clamped together to provide axial clamping of the workpiece. Again, all threaded openings have parallel axes. The structures of Billman and Totten are both difficult to secure in a position where the threaded workpiece can be acted upon.

SUMMARY OF THE INVENTION

In order to aid in the understanding of this invention, it can be stated in essentially summary form that it is directed to a fixture for holding threaded workpieces wherein the fixture has two webs. The webs are integrally formed with respect to each other and are positioned at a right angle with respect to each other. Separate threaded holes of various sizes and thread pitches are formed in each of the webs, with the holes in each web having an axis at a right angle with respect to the axes of the holes in the other web to provide convenient securement of the fixture and the threaded workpiece for working upon the threaded workpiece.

It is, thus, an object and advantage of this invention to provide a fixture for holding threaded workpieces wherein the fixture can be conveniently secured and the workpiece is conveniently positioned for working thereon.

It is another object and advantage of this invention to provide a fixture for holding threaded workpieces wherein the fixture has a plurality of different screw-threaded openings so that the fixture can be used for threaded workpieces of different sizes.

It is another object and advantage of this invention to provide a fixture for holding threaded workpieces wherein the fixture is strong and the threaded workpieces can be rigidly mounted with respect thereto to provide the necessary structural support for the threaded workpiece to resist cutting forces.

It is another object and advantage of this invention to provide a fixture for holding threaded workpieces wherein there is a space adjacent the web of the fixture for the bolt head when the threaded fixture is a bolt to permit manipulation of the bolt or holding of the bolt while work is done thereon.

It is another object and advantage of this invention to provide a fixture for holding threaded workpieces wherein there is space adjacent the fixture for a nut to be tightened on the threads of the workpiece against the fixture for securing the threaded workpiece within the fixture, and there is space due to the angular nature of the fixture to permit wrenches to be used on the nut and/or bolt head.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of the fixture for holding threaded workpieces in accordance with this invention.

FIG. 2 is an isometric view on a reduced scale and at a right angle with respect to FIG. 1 showing the fixture holding a threaded workpiece and being clamped in a work-holding device for holding during working thereon.

FIG. 3 is a left end view of the structure in FIG. 2 on an enlarged scale.

FIG. 4 is an isometric view of the fixture attached to a drill press table showing the manner in which a threaded workpiece can be acted upon by drilling.

FIG. 5 is an elevational view showing the fixture clamped in a vise and showing a threaded workpiece secured in the fixture being worked on by a file.

FIG. 6 is an isometric view similar to FIG. 4, but showing the fixture clamped on a workbench top and showing a threaded workpiece being acted upon by a hack saw.

FIG. 7 is a side-elevational view of a truck, with most of the truck broken away, showing the fixture of this invention secured thereon so that a threaded workpiece may be held therein.

DESCRIPTION OF THE PREFERRED EMBODIMENT

The fixture for holding threaded workpieces, in accordance with this invention, is generally indicated at 10 in FIGS. 1, 2, 3, 4, 5, 6 and 7. The fixture is integrally formed with webs 12 and 14. The fixture may be cut from a length of angle iron which is hot-rolled or cold-rolled and suitably finished. The material is preferably steel, and the webs are of sufficient thickness so that, when a screwthread is cut in an opening in the web, there is sufficient thread for strong support of the screwthread. Webs ¼ inch to ⅜ inch thick would be suitable in mild steel for a fixture 10 of moderate size. The webs are finished with outer surfaces 16 and 18, respectively, which are at a right angle with respect to each other.

The purpose of the fixture is to support screw-threaded parts, such as machine screws and bolts. In order to support such threaded workpieces, threaded holes are provided through the webs. In order to support threaded workpieces of various different sizes, these threaded openings are in various sizes. The sizes are preferably in the common screwthread standards. The American Standards Association formulates standards for such structures. There is a coarse thread series (UNC and NC) for rapid assembly in softer metals; there is a fine thread series (UNF and NF) for applications requiring greater strength; and there is an extra-fine thread series (UNEF and NEF) for highly-stressed parts and where internal threads are required in thin-walled fasteners. In addition, there is an international standard for metric screwthreads. Furthermore, in the automotive industry, the Society of Automotive Engineers has established an SAE screwthread series. To be complete, the fixture for holding threaded workpieces should have threaded openings therein in the two American Standards Association series, NC and NF, together with the metric series and the SAE series. The sizes and thread series of the most used workpieces are established and corresponding openings provided. If a wide range of openings is desired, one fixture 10 may incorporate the American Standards Association NC series of holes in one web 12, with the NF series in the other web 14. With such an arrangement, another fixture 10 would have the metric series on one web 12 and the SAE series on the other web 14. This is more desirable than making the length along the juncture of the outer surfaces 16 and 18 too long. For the purpose of illustration in the preferred embodiment, one standard series of holes is provided in one web and another standard series is provided in the other web.

In FIG. 1, web 14 has a series of ASA national course threaded openings, with one of each selected from that series. Threaded openings 20, 22, 24 and 26 are provided as an example. The other web 12 has a series of threaded openings therein, with the threaded openings 28, 30 and 32 being examples of a plurality of threaded openings, in the ASA national fine series of threaded openings. As is best seen in FIG. 1, additional openings are provided, with one of each size in the selected part of this series, the selected part being those threaded openings which correspond to the most used threaded workpieces.

The threaded openings can be used to determine the thread and the size of an unknown workpiece by selectively threading it into the different threaded openings and finding which threaded opening it actually properly fits. The principal purpose of the fixture 10 is not as a thread and size gauge, but as a holder for a threaded workpiece. In FIGS. 1, 2 and 3, bolt 34 has a threaded shank 36 and a head 38. Bolt 34 is threaded through the opening 26, which is a corresponding threaded opening to its own threads. When it has been threaded a sufficient distance in for exposure of the shank, lock nut 39, see FIGS. 1 and 3, is tightened against the inside of the web 14. This locks the bolt in place.

In the example shown in FIGS. 1, 2 and 3, the bolt has a length L under the head, and the desired length is $L_2$. The bolt is cut to length on a metal-cutting chop saw. The metal-cutting chop saw has a blade 40, see FIG. 2, which is a metal-cutting blade such as an abrasive blade. The blade can be brought down toward chop saw table 42. Such tables usually have a vise permanently attached thereto as part of the chop saw. The vise shown in FIG. 2 has a fixed jaw 44 and movable, clamping jaw 46. The web 12 of the fixture is clamped in the vise jaws with the outer surface 18 of the other web perpendicular to the axis of rotation of the blade 40. The outer surface 18 is positioned directly adjacent the blade 40 so that the blade cuts the bolt as close to the surface 18 as is practical without cutting the surface 18, see FIG. 3. As the blade is brought down, the bolt 34 is cut to the desired length. Bolts of different diameters can be cut by holding them in the corresponding selected threaded hole. If the bolt does not fit one of the holes in web 14, then the web 14 is clamped in the vise with the web 12 upstanding. In this way, the selected threaded opening in the web 12 is used to support the corresponding threaded workpiece. Since the two webs are at a right angle with respect to each other, one can be clamped in the vise as a means for securing the fixture, and the other is upstanding for holding the threaded workpiece. The upstanding position is essential in this cutting operation with the chop saw.

The fixture 10 can be used in other applications wherein the right angle orientation of the two webs is also very desirable to aid in the holding of the fixture and the corresponding workpiece. For example, in FIG. 4, the fixture 10 has its web 12 secured to a drill press table 46. Attachment is accomplished by means of a bolt 48 passing through one of the larger threaded openings in web 12 as a clearance hole, together with a nut under the slot 50 in the drill press table. On the other hand, if a bolt were available to fit one of the threaded openings in the web 12, such could be passed up from the bottom with its head under slot 50 and its thread engaging in the opening in web 12. This would secure the fixture 10 in place.

In the example shown in FIG. 4, the threaded workpiece 52 is a bolt threaded through a corresponding opening in the upstanding web 14, together with a lock nut to hold the threaded bolt in the desired position. Drill 54 is then brought down to drill a hole in the threaded workpiece 52. When complete, the threaded workpiece is released from web 14. It is seen that the two webs oriented at a right angle with respect to each other are essential to this utilization.

In FIG. 5, the web 12 is captured in the jaws of vise 56. In this positioning of web 12, the web 14 is upstanding and its threaded workpiece 58 is positioned for work thereon. In the present instance, the illustrated work is filing on the threaded workpiece by means of file 60. The right angular positioning of the two webs places the workpiece in convenient position for work thereon.

A similar arrangement is shown in FIG. 6 wherein the fixture 10 is clamped to a workbench 62 by means of visegrip pliers 64. In this case, the fixture 10 is held so that threaded workpiece 66 is held in the upstanding web 14 for work thereon by hacksaw 68. In FIG. 7, the fixture 10 is attached to the bumper 70 of pickup truck 72 so that its workpiece can be held in the upstanding web. In this case, a bolt 74 releaseably holds the fixture 10 in position so that either of the webs can be positioned in upstanding orientation for holding the selected threaded workpiece. It is clear that, in each of these utilizations, the positioning of the webs at an angle with respect to each other permits one to be a clamping web for attaching the fixture in place; and the other, a holding web for holding the threaded workpiece in position for convenient access and operation thereon.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A fixture for holding threaded workpieces, comprising:

a first web and a second web, said first web and said second web being integrally formed as a unitary fixture, said first web and said second web being of uniform thickness, said first web and said second web each having a substantially planar outer surface, said substantially planar outer surfaces of said first web and said second web being positioned at a right angle with respect to each other;

walls defining a plurality of threaded openings through said first web and walls defining a plurality of threaded openings through said second web, said plurality of openings having different sized from each other and having different thread pitches thereon so that different threaded workpieces of different sizes can be threaded into different ones of said plurality of openings so that said fixture can be secured by one of said webs and a threaded workpiece can be secured in an opening in the other of said webs so as to hold the workpiece in convenient position for work thereon.

2. The fixture of claim 1 wherein said fixture is made of one piece of rolled steel so that said first and second webs have the same metallic grain structure therein.

3. The fixture of claim 1 wherein said openings in said first web each have an axis which is at right angles to said plane of said outer surface of said first web.

4. The fixture of claim 1 wherein, said plurality of threaded openings through said second web each being different than said threaded openings in said first web.

5. A fixture for holding threaded workpieces, comprising:

first and second webs on said fixture, said first and second webs being integrally formed with each other by forming of steel so that said first and second webs have a continuous grain structure therebetween, said first and second webs being of uniform thickness and respectively having first and second outer surfaces, said first and second outer surfaces being planar, said planar first and second outer surfaces being positioned at substantially a right angle with respect to each other, said fixture being made of steel;

walls in said first web defining a plurality of threaded openings through said first web, each of said openings having an axis, each of said axes being at a right angle with respect to said planar outer surface of said first web, said plurality of threaded openings defining at least a portion of a thread series so that threaded workpieces of different sized can be threaded into and secured into a selected one of said threaded openings so that a threaded workpiece can be secured with respect to said first web and said second web can be secured for working on a threaded workpiece; and walls defining holes through said second web defining a plurality of threaded openings through said second web, said threaded openings each having an axis and said axes being substantially at a right angle with respect to said planar outer surface on said second web, said threaded openings being sized and threaded to be at least a portion of a standard series of threaded openings.

6. The fixture of claim 5 wherein said threaded openings in said second web are in a different series than said threaded openings in said first web.

7. The fixture of claim 5 wherein the length of said fixture along the intersection of said planar web outer surfaces is sufficient so that said second web can be clamped in a chop saw vise.

* * * * *